United States Patent [19]

Straitz, III

[11] 4,268,245

[45] May 19, 1981

[54] OFFSHORE-SUBSEA FLARES

[75] Inventor: John F. Straitz, III, Meadowbrook, Pa.

[73] Assignee: Combustion Unlimited Incorporated, Elkins Park, Pa.

[21] Appl. No.: 74,783

[22] Filed: Sep. 12, 1979

Related U.S. Application Data

[63] Continuation-in-part of Ser. No. 868,711, Jan. 11, 1978, abandoned.

[51] Int. Cl.[3] ..... F23D 13/20

[52] U.S. Cl. ..... 431/202; 431/278; 431/264

[58] Field of Search ..... 431/202

[56] References Cited

U.S. PATENT DOCUMENTS

| | | | |
|---|---|---|---|
| 1,087,112 | 2/1914 | Fiedler . | |
| 2,656,008 | 10/1953 | Engel | 431/121 |
| 2,894,269 | 7/1959 | Dodge | 9/8.3 |
| 2,955,673 | 10/1960 | Kennedy et al. | 183/4.1 |
| 3,200,636 | 8/1965 | Flumerfelt | 73/29 |
| 3,399,510 | 9/1968 | Kauer et al. | 55/33 |
| 3,652,196 | 3/1972 | Mariol et al. | 431/202 |
| 3,666,395 | 5/1972 | Kubasta | 431/202 |
| 3,816,059 | 6/1974 | Straitz | 431/278 |
| 3,824,073 | 7/1974 | Straitz | 431/284 |
| 3,902,843 | 9/1975 | Genini et al. | 431/202 |
| 3,920,378 | 11/1975 | Castela et al. | 431/202 |
| 4,025,281 | 5/1977 | Lapp | 431/5 |

FOREIGN PATENT DOCUMENTS

| | | | |
|---|---|---|---|
| 2742549 | 3/1978 | Fed. Rep. of Germany | 9/8.3 R |
| 1244273 | 8/1971 | United Kingdom . | |

*Primary Examiner*—Carroll B. Dority, Jr.

*Attorney, Agent, or Firm*—Seidel, Gonda, Goldhammer & Panitch

[57] ABSTRACT

An ignitor is provided for offshore-subsea flares in which a flare, floating or fixed, is provided separated from an offshore drilling platform but connected by a subsea conduit or connection, preferably flexible, through which fuel gas is delivered to the flare for pilots and for ignitor gas for the pilots and which has provisions for insulated conductors for control of the pilot gas, the ignitor gas and for the ignition of the ignitor gas and indication of operating conditions.

20 Claims, 15 Drawing Figures

OFFSHORE-SUBSEA FLARES

CROSS REFERENCE TO RELATED APPLICATIONS

This application is a continuation in part of my prior application filed Jan. 11, 1978, Ser. No. 868,711 and now abandoned.

BACKGROUND OF THE INVENTION

1. Field of the Invention

This invention relates to offshore gas flares and more particularly to apparatus for igniting waste gas for combustion at a location spaced from an offshore well.

2. Description of the Prior

It has heretofore been proposed as in U.S. Pat. No. 1,087,112, to burn gas on the surface of the water released below the surface through a nozzle carried on a buoy. In order to ignite the gas a lump of potassium, sodium or calcium phosphid is released from below the water surface by the pressure of the fuel, rises to the surface of the water and ignites to ignite the gas. Only a single ignition is intended, or possible, combustion being maintained by continuous supply of gas.

Flares for offshore use and capable of accommodation to changes of depth due to wind, tides and the like are shown in U.S. Pat. No. 2,894,269 to Dodge; U.S. Pat. No. 3,652,196 to Marion et al.; U.S. Pat. No. 3,666,395 to Kubasta; U.S. Pat. No. 3,902,843 to Genini et al.; and U.S. Pat. No. 3,920,378 to Castela.

Of these only Castela et al. in U.S. Pat. No. 3,920,378, undertake to provide a lighting device which is shown only diagrammatically and is described only as of the type producing electrical impulses to produce sparks at the level of the night lights and which apparently require the intervention at the flare of a workman for actuating the lighting circuits. Reference is also made to the intended use of a fuse on FIG. 1 but this is not otherwise shown nor described.

Lapp, in U.S. Pat. No. 4,025,281, has only a pilot system and no automatic or remote control means for the pilot gas. The pilot gas is manually adjusted by valve 104 and flows continuously without adjustment automatically or remotely. The pilot and ignitor system of Lapp differs greatly from the system of applicant in that it is essential in Lapp to set up the system with the proper continuous pilot gas flow and thereafter effect the ignition automatically.

Lapp's igniter utilizes a flame front propagated through a pipe to the pilot. The use of a flame front is wholly unsuited for transmission through a pipe submerged in ocean water. The flame front itself produces water vapor which would condense in a submerged ocean water cooled pipe and tend to block the pipe with repeated propagation, even if both the air and gas to produce the flame front were essentially water free. Lapp recognized the problems attendant upon cooling of the pipe through which the flame is advanced (See column 3, line 61 through column 4, line 21). The present invention uses an entirely different approach, does not advance a flame through a subsea pipe but merely transmits fuel gas which can be dried and establishes the flame front at the flare itself.

Kubasta, in U.S. Pat. No. 3,666,395 makes no provision for a pilot or for igniting a pilot but indicates (column 3, line 74 and following) that a ladder may extend to the burner tip for lighting the same.

British Pat. No. 1,244,273, to Mobil Oil Corporation shows a semi-submersible drilling vessel 32 with a drill string 30, a plurality of subsea production satelite systems 10, each serving a plurality of subsea wellheads 14, with shipping lines 18 extending therefrom to a storage tank 17. A floating master station 20 is provided connected to the tank 17 through a tethered tension pipe 22 with a large subsurface buoy 24 at its upper end. The master station 20 has power generating and final stage separation equipment as well as offloading apparatus. A flexible conduit 26 connects the master station 20 to the tethered tension pipe 22 and is provided with a plurality of electrical and fluid flow paths, the electrical connections apparently supplying energy to the satelite stations 10 and the fluid flow paths transferring fluid from the tether pipe 22 to the master station 20 for final stage separation.

It is indicated (page 6, line 95 and following) that the separated gas can be utilized, stored, or disposed of at the site, by flaring (line 112). If the gas is to be flared (lines 121 and 122) a flare stack is erected above the master station 20. No details of the flare stack are described.

It is not particularly desireable to locate a flare stack continguous to oil separation and offloading equipment and the structure of this British patent bears little resemblance to transferring gas for flaring from an offshore platform to a separated flare.

If the flow of gas to be burned to an offshore flare is continuous, a single ignition may be adequate but if the flow is interrupted then difficulties are encountered. Various expedients have been resorted to for ignition of offshore flares including the use of Roman candles, flare pistols, and tracer bullets but these have not proven satisfactory.

Hazards to personnel, because of combustible liquid carryover, vapor clouds and high radiation from burning flares add to the problem.

It has been common practice to ignite flares supported above the ground by the use of flame fronts to ignite gas fired pilots. My prior U.S. Pat. No. 3,816,059 shows such a system. These are not feasible with offshore flares because of chilling of the flame carrying pipe by the surrounding water and condensate build-up in subsea pipes.

SUMMARY OF THE INVENTION

In accordance with the invention an ignition system is provided for offshore flares with provisions at the offshore platform for monitoring the condition of and treating the fuel gas for pilots and ignition and for supply of electrical energy, with provisions at the flare for pilot and pilot ignitors, and with a suitable conduit or connector between the platform and the flare for supply of fuel gas, electric power and for signals to indicate pilot conditions.

It is the principal object of the invention to provide an ignition system for offshore flares which are separated from offshore wells and platforms and which will be reliable in use and not hazardous to personnel.

It is a further object of the invention to provide an ignition system for offshore flares which is easy to install.

It is a further object of the invention to provide an ignition system for offshore flares in which a supply of fuel gas is provided for pilot gas and for ignitor gas and in which the condition of the fuel gas is monitored and the gas is preconditioned prior to departure from the platform.

It is a further object of the invention to provide an ignition system for offshore flares which are separated from offshore wells and platforms which includes a back up battery.

It is a further object of the invention to provide an ignition system for offshore flares which are separated from offshore wells and platforms having a simple but effective conduit or connection between the platform and the flare.

It is a further object of the invention to provide an ignition system for offshore flares which are separated from offshore wells and platforms and in which a supply of fuel gas to the flare is utilized and controlled for pilots and for ignition.

It is a further object of the invention to provide an ignition system for offshore flares which are separated from offshore wells and platforms and in which the temperature conditions prevailing at the flame are utilized to control the ignition of a pilot.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Referring now more particularly to the drawings and first to FIG. 1, an offshore platform is shown at P having a drilling rig 11, and fuel gas supply and control equipment 12 with a connecting conduit 13, hereinafter described, for ignition, extending to an offshore flare 14.

Figure 1:
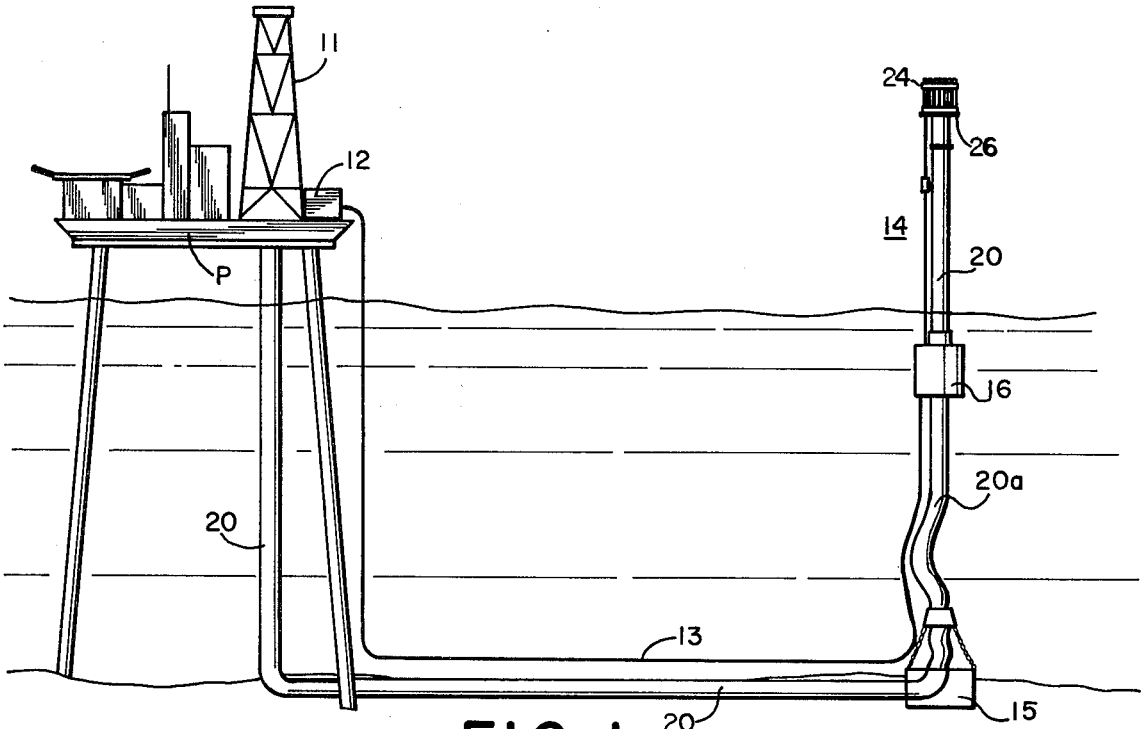
FIG. 1 is a view in elevation of an offshore platform, an offshore flare of the buoy type, and the connection therebetween in accordance with the invention.
Figure 3:
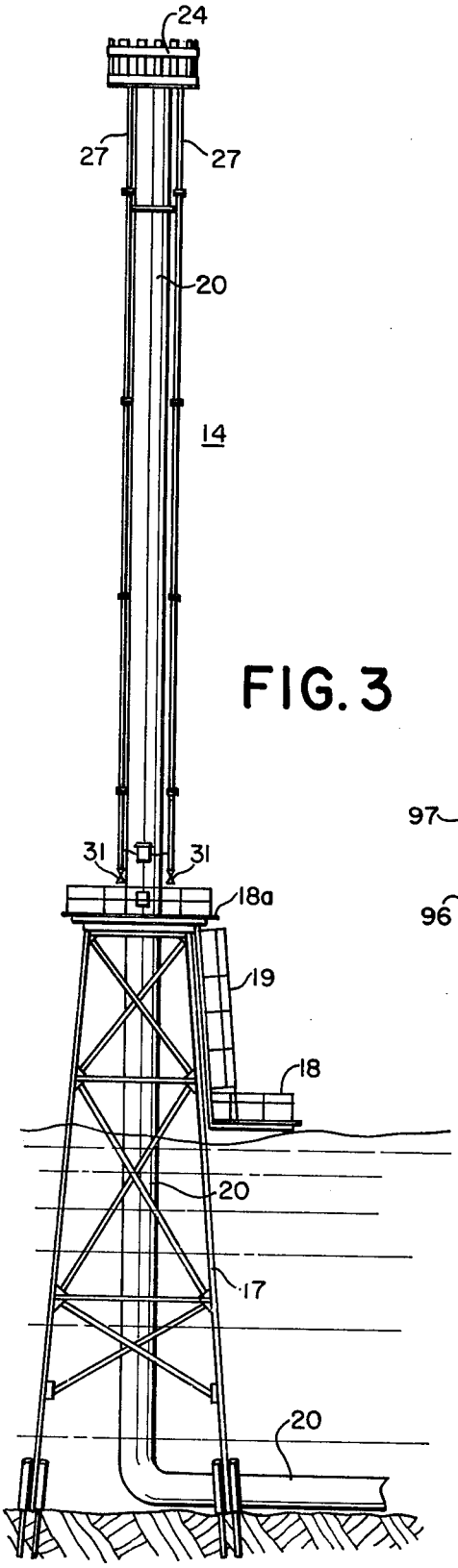
FIG. 3 is a view in elevation of a flare in accordance with the invention which is supported from the sea floor.

The offshore flare 14 can be of the buoy type with a bottom anchor 15 and buoy 16 as illustrated in FIG. 1, or can be supported by an anchored base frame 17 extending upwardly as illustrated in FIG. 3, with a step off platform 18 and ladder and cage 19 to the access platform **18*a*, of the flare 14**.

The flare 14 preferably has a waste gas supply pipe 20 extending thereto from the platform P which may have a flexible section **20*a* for a free floating type flare 14 as shown in FIG. 1. The pipe 20 can have a burner end 21 with flame retention members 22 at the burner end 21**.

The flame retention members can be of any desired type as heretofore employed or can be as shown and described in my application for U.S. Letters Patent filed July 13, 1977, Ser. No. 815,100, now U.S. Pat. No. 4,116,618.

The flare 14, at the burner end is preferably provided with a windshield 24 having a plurality of spaced vertical slats 25 and a bottom wall 26 through which one or more pilot gas supply pipes 27 extend for supplying a gas/air mixture to pilots 28. In the particular embodiment illustrated in FIG. 4, two pilots 28 are shown, but the number of pilots 28 will be determined in a specific design by the diameter of the pipe 20 and wind conditions at the burner end 21 of the pipe 20.

Within the interior of the pipe 20 and preferably spaced downwardly from the flame retention members 22, a fluidic diode 23 is provided which permits free upward flow of the gas to be burned but interposes a resistance to downward flow in the pipe 20. The fluidic diode can be that shown in my prior U.S. Pat. No. 3,730,673.

The pilot gas supply pipes 27 are supplied with fuel gas from a fuel gas supply ring 30 through air inspirating venturis 31.

Air for the venturis 31 is preferably supplied through an air inlet 33 which includes, in a housing 34, an apertured air-adjustment member **34*a***.

An ignitor pipe 40 is provided for each pilot 28 and extending thereto with an ignitor gas supply pipe 41 connected thereto through a venturi 42, similar to the venturi 31, and having an air inlet 33 which includes, in a housing 34, an apertured plate 35 with a valve plate 36 normally urged to open position by a spring 37 but movable to closed position in the event of an explosion beyond the air inlet 33. A handle 38 can be provided to check the movement of the plate 36 if desired.

Figures 4, 4A, 7:
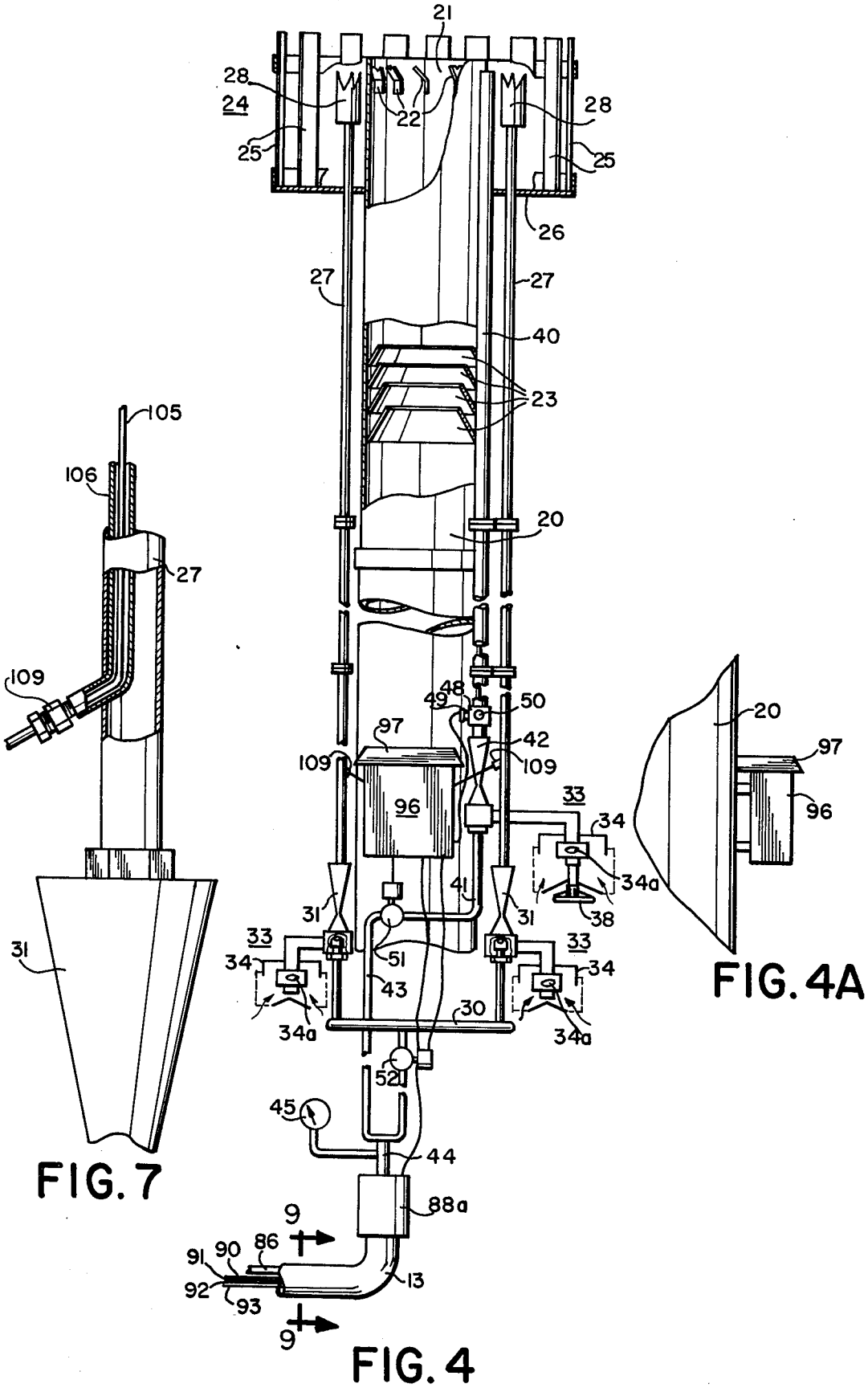
FIG. 4 is an enlarged view in elevation, parts being broken away, and showing the details of the waste gas burner, the pilot gas supply, the ignition gas supply and the ignitor.
FIG. 4A is a fragmentary view in elevation showing the control box of FIG. 4.
FIG. 7 is an enlarged view of a portion of the pilot gas supply pipe showing the thermocouple conduit carried thereby.

In FIG. 4 only one ignitor assembly is shown but each pilot 28 is provided with its own ignitor assembly.

Fuel gas is supplied through a pipe 41 to the inlet of the venturi 42 by means of solenoid valve 51 and pipe 43. The ring 30 and the pipe 43 are supplied with fuel gas from a pipe 44 having a pressure gage 45 connected thereto.

An ignition fitting 48 is provided in the pipe 40 beyond the venturi 42 having an igniting spark plug 49 therein and a viewing opening 50 to observe conditions at the spark plug 49.

The pipe 43 has a solenoid controlled valve 51 therein and a solenoid controlled valve 52 is provided between the pipe 44 and the ring 30.

Figure 8:
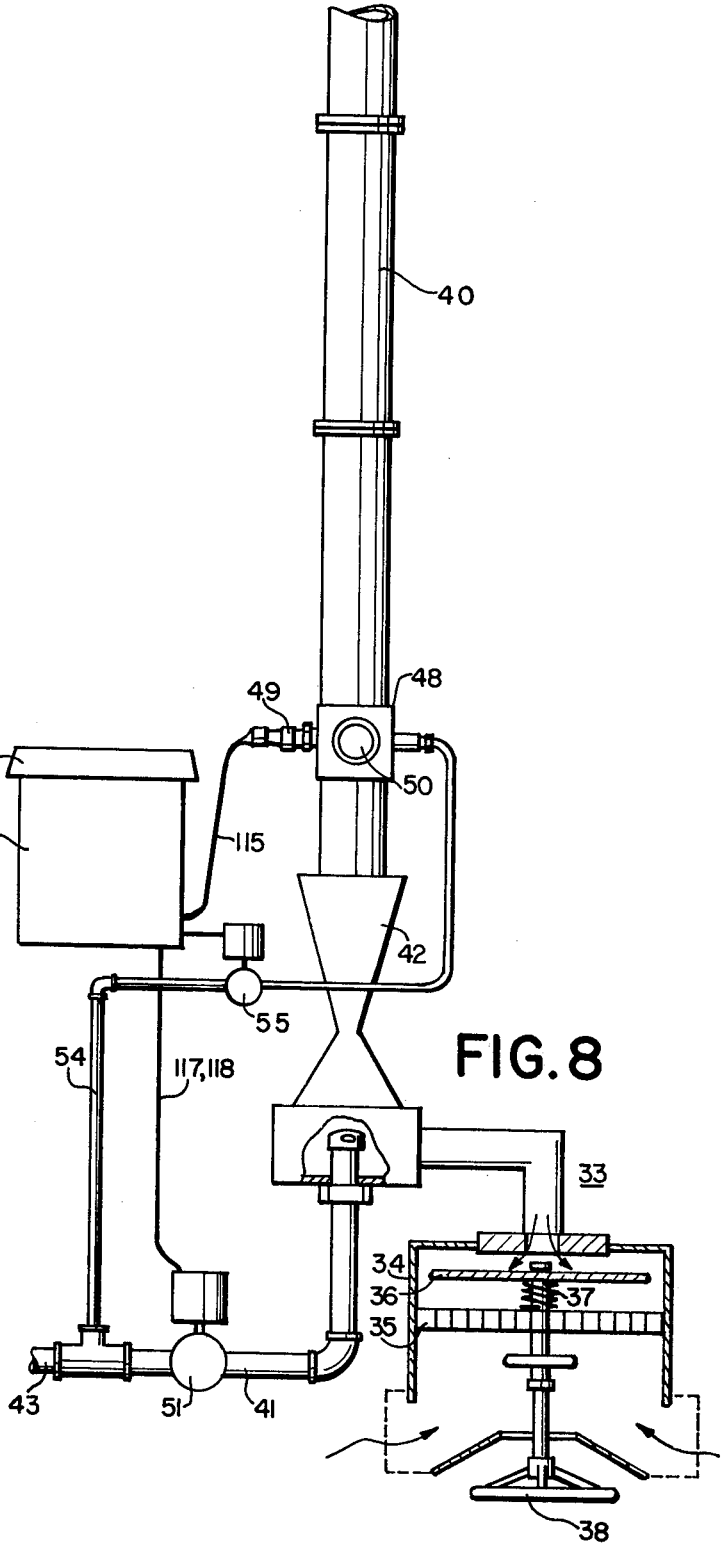
FIG. 8 is a view in elevation on a larger scale than FIG. 4 and showing details of the ignitor pipe and ignitor.

Referring to FIG. 8, a bypass pipe 54 can be provided around the valve 51 and to the ignition fitting 48, controlled by a solenoid valve 55 for supplying gas under pressure directed against the gap of the spark plug 49 for cleaning the plug.

Figure 2:
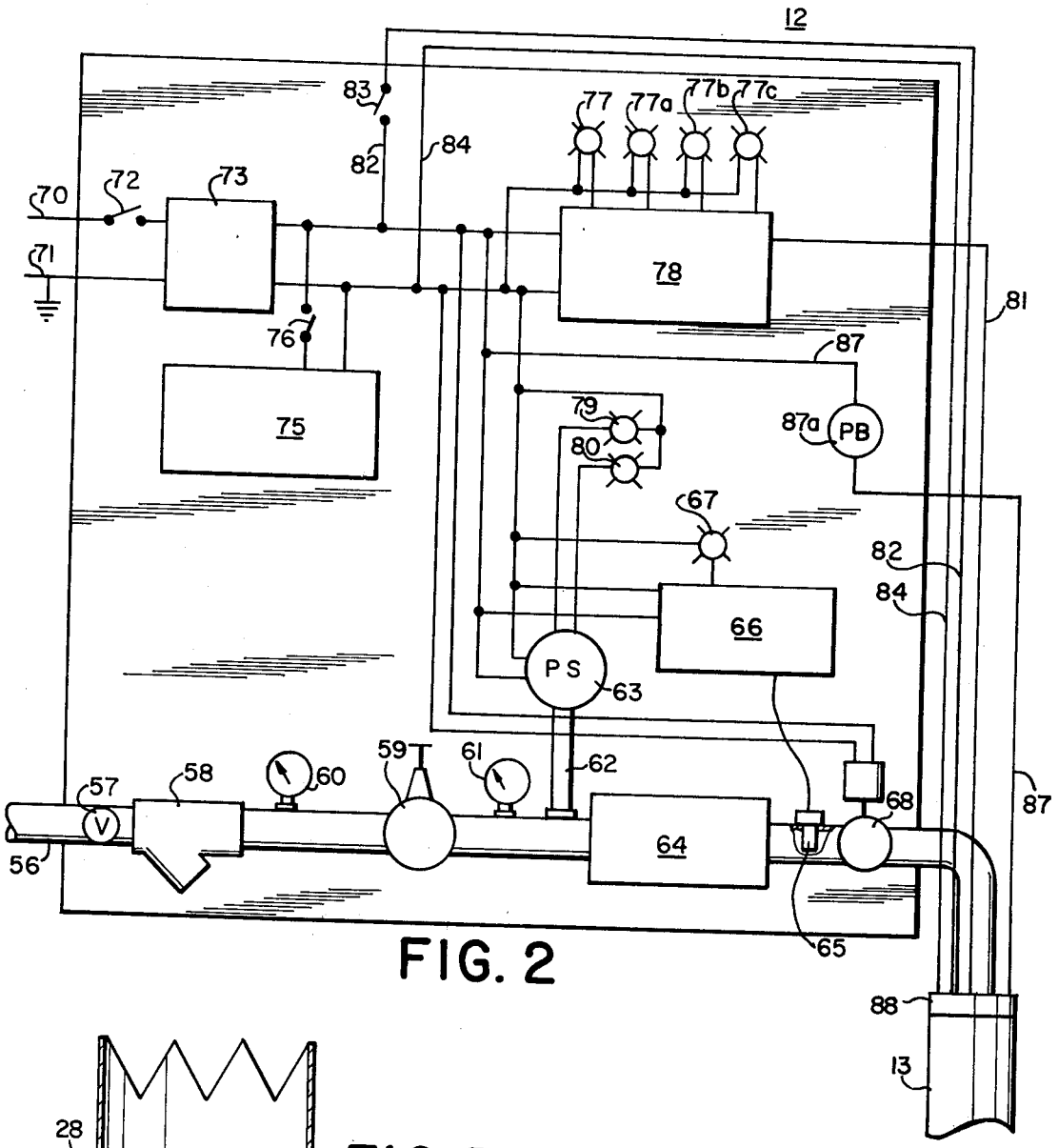
FIG. 2 is a diagrammatic view of the fuel supply line for ignition and controls therefor which are located at the offshore platform.

Referring now to FIG. 2 a fuel gas supply pipe 56 is provided connected to a source of fuel gas for pilot operation and ignitor operation.

The pipe 56, as shown in FIG. 2, is connected through a manual shut-off valve 57, a strainer 58, and a pressure regulating valve 59 for adjustment of the delivered pressure of the fuel gas to the desired pressure level. A pressure gage 60 is connected to pipe 56 ahead of the pressure regulator 59 and a pressure gage 61 is provided downstream of the pressure regulator 59 for observation of the fuel gas pressure. The pipe 56 also has a connection 62 to a pressure switch 63. The pipe 56 extends to a drier 64 of any desired type, such as a refrigerated or a chemical drier, for elimination of liquid from the fuel gas. A dew point sensor 65 is provided in the pipe 56 which is connected to an audible dew point alarm 66 and a visual dew point alarm 67.

The pipe 56 also has a solenoid valve 68 therein which is connected to the power supply as hereinafter described.

The fuel gas supply and control equipment, as shown in FIG. 2, includes power leads 70 and 71 which are connected through an on-off switch 72 and through a step down transformer and rectifier 73 to provide the desired voltage for control purposes, such as 24 volts. A rechargeable battery pack 75 can be provided, controlled by a manually operable switch 76 for emergency power supply.

The output lines from the transformer and rectifier 73 are connected to a controller 78 and to the pressure switch 63, indicating lights 79 and 80 being provided to indicate high gas pressure or low gas pressure in the pipe 56. Pilot indicator lights 77, **77*a*, 77*b* and 77*c* are provided activated by the controller 78**.

The power leads 70 and 71 have connected thereto a conductor 82 with a switch 83 and a conductor 84.

The controller 78 also has a signal input connection 81 for signal input determined by operation of the pilots 28, as hereinafter explained.

A conductor 87, connected to the conductor 70, and with a pushbutton **87*a* therein can be provided for spark plug cleaning of the pilots 28**, as hereinafter explained.

Figure 9:
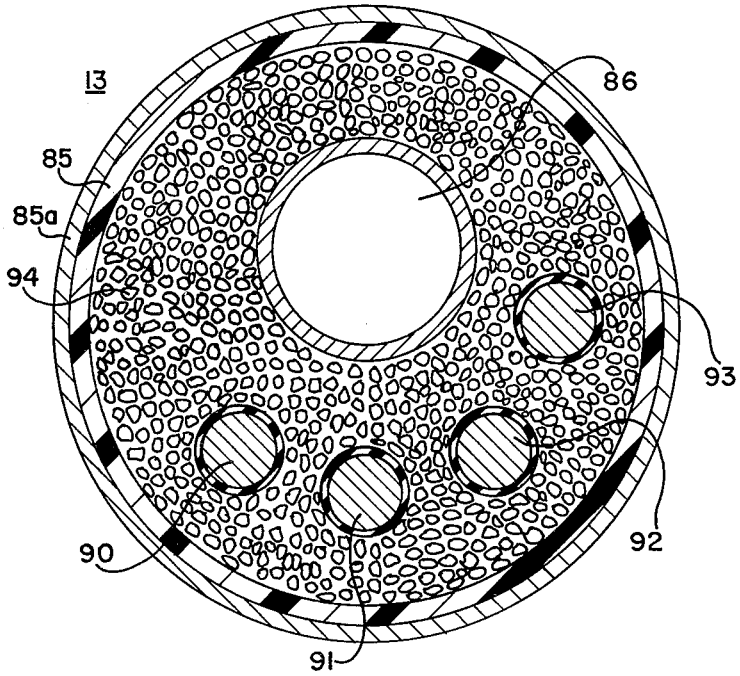
FIG. 9 is a transverse sectional view, taken on the line 9—9 of FIG. 4 and showing the details of the connector or conduit between the offshore platform and the offshore flare.

As shown in FIG. 9, a connecting conduit 13 is provided, preferably flexible, with an outer sheath 85 which may be of teflon or other suitable waterproof material and with a spiral wound flexible corrosive resistant metal sheath **85*a* within which a flexible fuel gas pipe 86 is disposed. The pipe 86 is connected to the pipe 56 and within the sheath 85 through a fluid tight connector 88 and at the other end through a fluid tight connector 88*a* to the pipe 44** for supply of pilot gas and ignitor gas.

Within the conduit 13 a plurality of insulated flexible conductors 90, 91, 92 and 93 are provided connected respectively to the conductors 82, 84, 81 and 87. The space within the sheath 85 and surrounding the pipe 86 and the conductors 90, 91, 92 and 93 can be filled with any desired heat insulating and electrical insulating material 94 such as synthetic plastic pellets for flexibility of the conduit 13.

Figure 10:
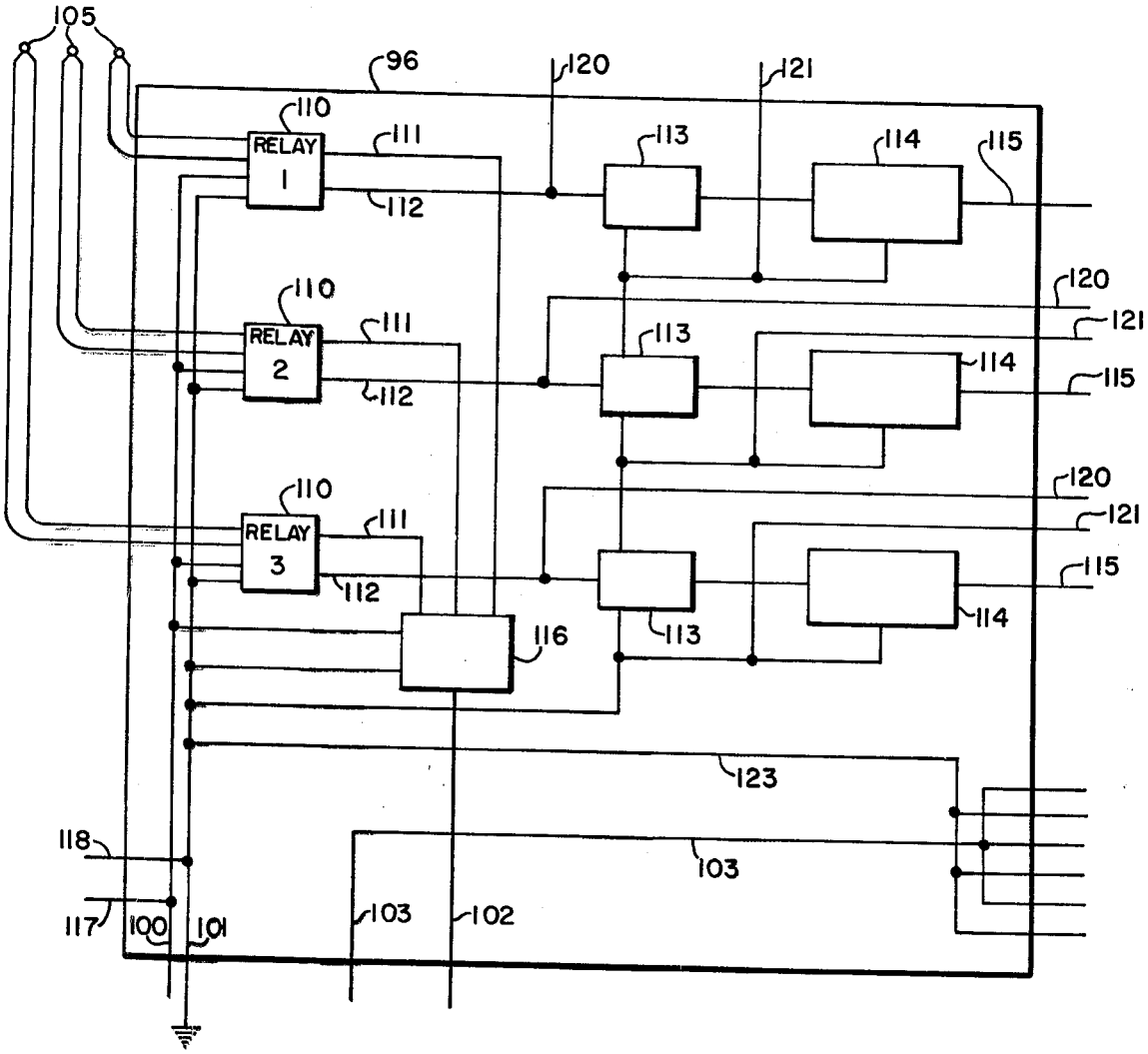
FIG. 10 is a diagrammatic view of the controls located at the flare.

Referring now to FIG. 10 the control equipment there shown is located within a control station box 96 at the lower part of the flare 14 which is protected against radiation by a radiation shield 97.

Conductors 90, 91, 92 and 93 extend through the fluid tight connector **88*a*, and are connected respectively to conductors 100, 101, 102 and 103 for the station box 96**.

Figure 5:
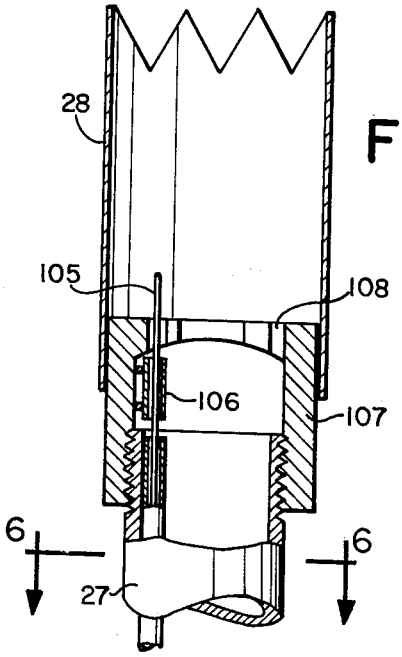
FIG. 5 is an enlarged vertical sectional view of the pilot.
Figure 6:
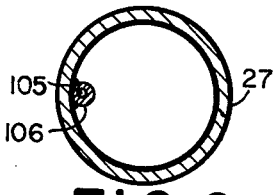
FIG. 6 is a horizontal sectional view taken approximately on the line 6—6 of FIG. 5.

Each of the pilots 28 has a thermocouple 105 (see FIG. 5) carried therein in a guide tube 106, which at its upper end is mounted in a pilot flame retention nozzles 107. The nozzle 107 has a plurality of flame retention ports 108 therein. The thermocouple leads extend through a gas tight coupling 109 (FIG. 7) on each pipe 27 and into the box 96.

In FIG. 4 only two pilots 28 are shown but in FIG. 10 three thermocouples 105 are illustrated diagrammatically and shown as connected respectively to temperature switch relays 110. The relays 110 have supply conductors 100 and 101 connected thereto and the relays provide signals through their conductors 111 if the thermocouple 105 indicates that there is a flame at its pilot 28 and through conductors 112 to provide signals to their ignition timers 113 and to an associated ignition transformer 114 if the signals indicate there is no flame at the respective pilot 28. Each transformer 114 is connected through a spark plug wire 115 to its respective spark plug 49.

The signals through the conductors 111 are also delivered to a controller 116 from which a signal is delivered through the conductor 102 to the conductor 81 and controller 78 for activation of the pilot indicating lights and as determined by the summation of the voltages of the signals through the conductor 81.

The controller 116 takes the signals in the conductors 111 and connects them to a lower voltage which can be summed up for measurement and indication of pilot status. The controller 116 produces a voltage signals which equals $$\frac{\text{voltage from transformer 73} \times \text{number of pilots operating}}{\text{total number of pilots}}$$

The controller 78 measures the voltage and gives an indication by means of the lamps **77, 77*a*, 77*b*, 77*c*. If all the pilots are out there is no voltage signal to controller 78. The controller 78 will activate a red pilot failure lamp 77**.

The energization of the power leads 100 and 101 is also effective through conductors 117 and 118 to open the solenoid valve 52 to supply pilot gas to all the pilots 28.

The signals in the conductors 112 are also effective through conductors 120 and 121 to open the solenoid valve 51 to supply ignition gas delivery to the venturi 42 so that the gas-air mixture at the spark plug 49 will be intermittently ignited as determined by the timer 113 to provide a series of flame fronts through the ignitor pipe 40 to ignite the gas-air mixture delivered to the pilots 28.

The solenoid 55 for each gas bypass 54 is connected by the signal conductor 103 and by conductor 123 to the conductor 101 so that upon energization of the signal conductor 101 a gas jet cleaning action is available at the spark plug 49 of each ignitor assembly.

Figure 11:
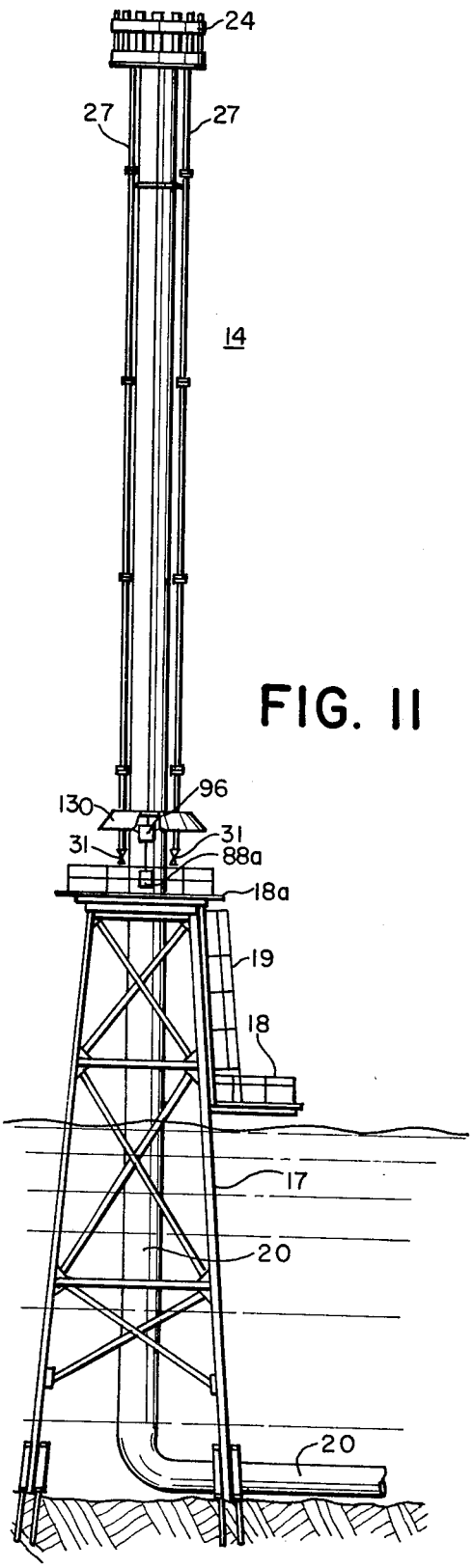
FIG. 11 is a view in side elevation of a protective shield employed in connection with the invention, parts being broken away to show the details of construction.

Referring now to FIG. 11, the flare 14 there shown is similar to that previously shown in FIGS. 3 and 4 and described above. A shield 130 is provided for protection of the control station box 96 against oil carried over and discharged through the top of the flare 14 at the burner end 21 and falling in burning droplets. The shield 130 is preferably an inverted dished plate carried on the pipe 20 and extending outwardly therefrom in covering relation to the box 96 and therebeyond. The shield 130 is preferably of stainless steel so as to be heat resistant.

Figure 13:
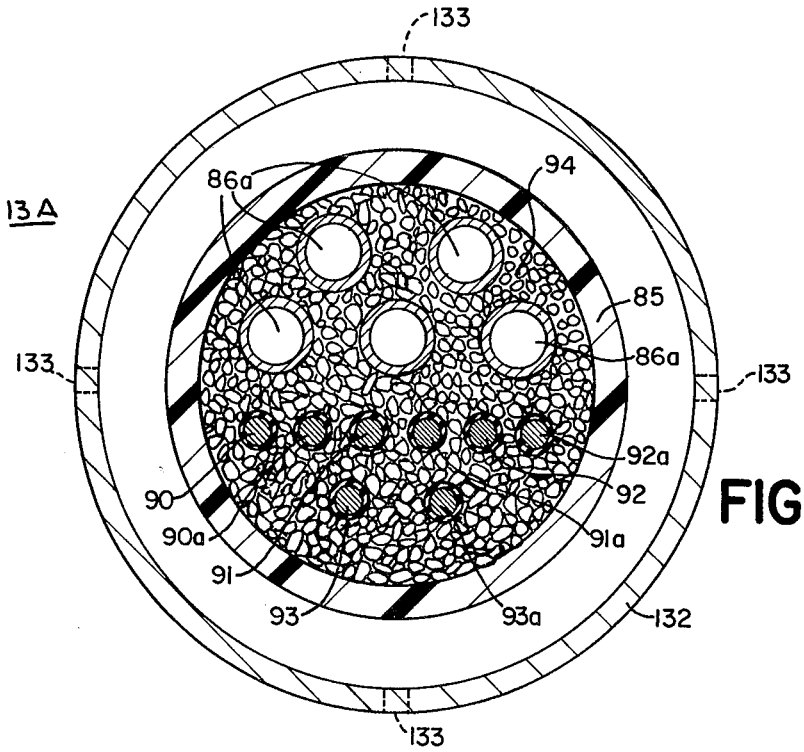
FIG. 13 is a transverse sectional view, enlarged, taken approximately on the line 13—13 of FIG. 12 and showing a modified form of conduit with a protective shield.

Referring now to FIG. 13 a modified form of flexible connecting conduit 13A is there illustrated which in place of the single pipe 86, as shown on FIG. 9, has a plurality of pipes **86*a* to reduce the likelihood of blockage, five being provided. Also, in place of four insulated conductors 90, 91, 92 and 93, eight insulated conductors are provided shown as 90, 90*a*, 91, 91*a*, 92, 92*a*, 93 and 93*a*. These pipes and insulated conductors are enclosed within a sheath 85 of teflon or other suitable waterproof material and the interior is filled with any desired heat insulating and electrical insulating material 94, such as synthetic plastic pellets for flexibility of the conduit 13A**.

Figure 12:
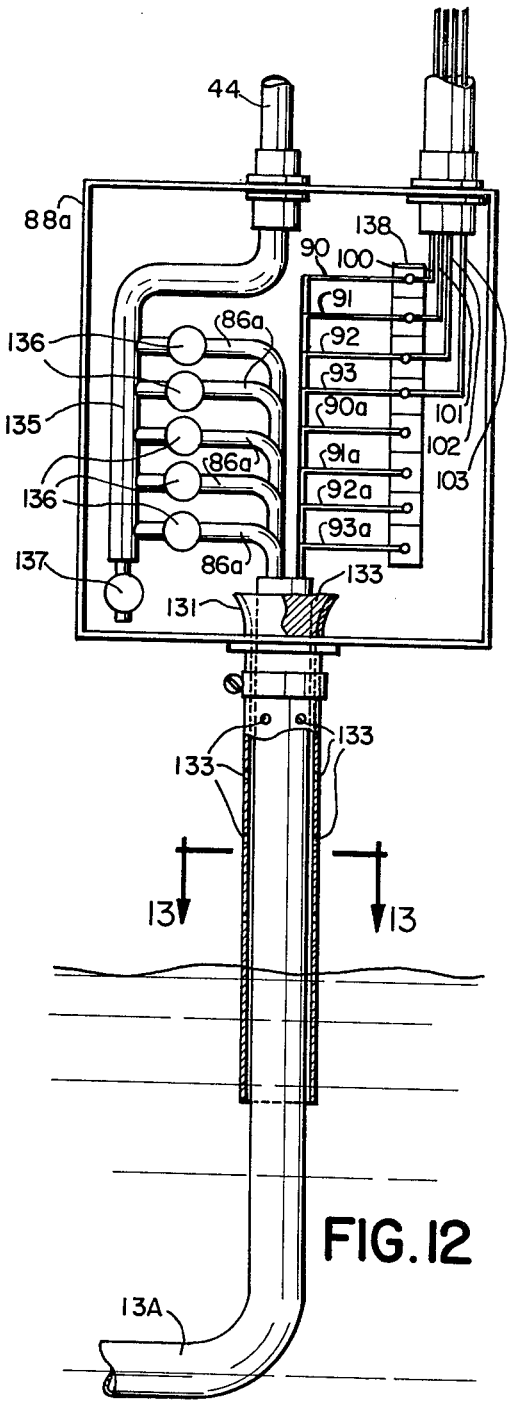
FIG. 12 is a view in elevation with the cover removed of a modified form of connector employed in connection with the invention.

The connecting conduit 13A is connected to the flare 14 as shown in FIG. 12. In surrounding relation to the conduit 13A a tubular metallic sheath 132 is provided, preferably of stainless steel, flared at its upper end with a fluid tight connection 131 and filled with potting compound 133 to the box **88*a*. The sheath 132 is spaced outwardly from the conduit 13A, extends a substantial distance below the surface of the sea, and is provided with a plurality of breathing or drain holes 133. The purpose of the sheath 132 is to protect the conduit 13A from thermal radiation, from contact by liquid carry over which may fall in burning droplets and to protect the conduit 13A** against bumping by boats or other objects.

The fuel gas pipes **18*a* each extends from the interior of the conduit 13A to a vertical manifold 135, each controlled by a valve 136. The manifold 135 is provided at its lower end with a drain valve 137 for liquid draining and the upper end of the manifold 135 has the pipe 44** connected thereto for fuel gas delivery.

The conductors **90, 90*a*, 91, 91*a*, 92, 92*a*, 93 and 93*a* each extends from the interior of the conduit 13A to an insulated connector strip 138. From the strip 138, four wires which may initially correspond to the conductors 90, 91, 92 and 93 are respectively connected to conductors 100, 101, 102 and 103, as before. In the event of failure of any of the conductors 90, 91, 92 or 93** additional conductors are available to maintain continued operation.

Figure 14:
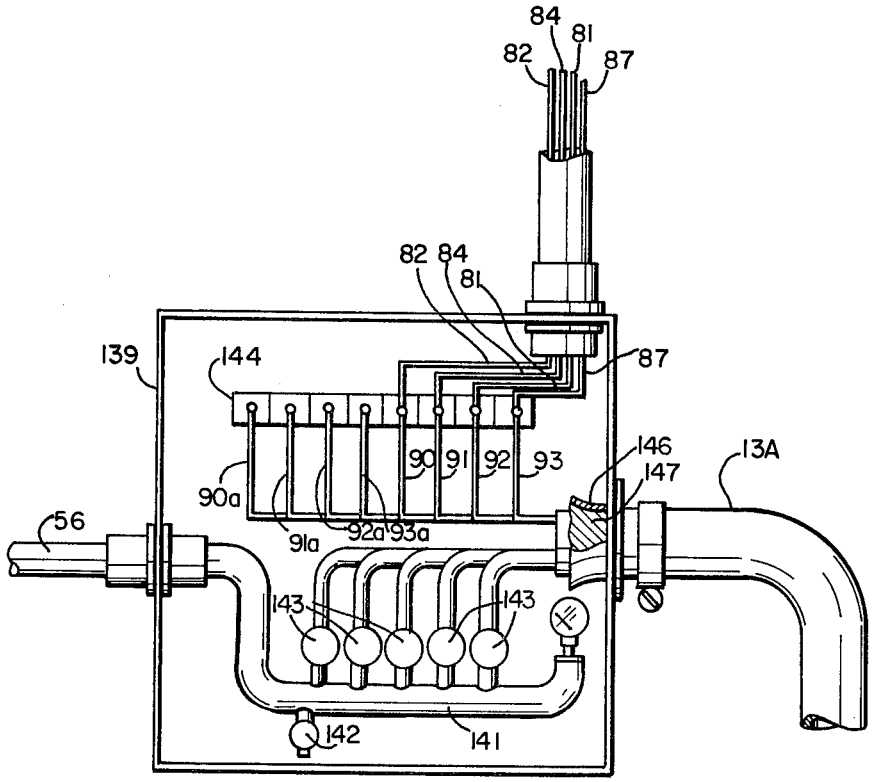
FIG. 14 is a view in elevation with the cover removed of a modified form of fuel gas supply and control equipment on the platform.

The connecting conduit 13A is connected to box 139 in series with the box containing the fuel gas supply and control equipment 12, as shown in FIG. 14.

The fuel gas supply pipe 56, from the solenoid valve 68 extends into the connecting box 139 to a manifold 141 which has a drain valve 142 and from which the pipes **86*a* extend, through valves 143, one for each of the pipes 86*a*. The wires 82, 84, 81 and 87 extend to an insulated connector strip 144 from which the wires 90, 90*a*, 91, 91*a*, 92, 92*a*, 93 and 93*a* extend into the interior of the conduit 13A. The conductors 90*a*, 91*a*, 92*a* and 93*a*** are available in the event of failure of any of the other conductors so that continued operation can be maintained.

The conduit 134 extends into the box 139 with a flared fluid tight connection 146 filled with potting compound 147.

The mode of operation should be clear from the foregoing but will be summarized briefly.

Combustible waste gas from the offshore platform P is delivered through the pipe 20 to the offshore flare 14 for discharge through the burner end 21.

Fuel gas supplied through the pipe 56, with valve 57 open, advances through strainer 58 for removal of solids and partial removal of entrained liquid and the delivered pressure is regulated by adjustment of the pressure regulator 59.

The fuel gas pressure as delivered from the pressure regulator 59 is available through the pipe 62 at the pressure switch 63.

The fuel gas advances through the drier 64 for removal of any liquid content which could condense when subjected to underwater temperatures between the platform P and the flare 14.

If there is vapor content above a predetermined level the sensor 65 will activate an audible alarm 66 and visual alarm signals 67.

The flow is also controlled by the solenoid valve 68 energized from the power output of the transformer 73.

As the fuel gas passes through the pipe 56 it advances into the gas pipe 86 in the connecting conduit 13 or through selected pipes **86*a* as determined by the valves 136 and 143. In the event that one or more of the pipes 86*a* is filled with liquid others of the pipes 86*a* are available for fuel gas delivery. The fuel gas passes through the pipe 44 at the offshore flare 14. The gas is divided and part of the fuel gas is delivered under the control of the solenoid valve 52 to the fuel gas ring 30 and then through the venturis 31 for air admixture for delivery to the pilots 28**.

Part of the fuel gas, under the control of the solenoid 51 passes to the venturi 42 for air admixture and for ignition by the spark plug 49 to delivery intermittent igniting flame fronts controlled by the timer 113 through the pipe 40 to ignite the gas-air mixture at the pilot 28.

The temperature at each thermocouple 105, if no flame is present at its pilot 28, will be effective to open the solenoid valve 51 for delivery of igniting gas to the spark plug 49, and for actuation of the timer 113 and through the ignition transformer 114 provide a spaced series of sparks at spark plug 49.

When there is a flame at the pilot 28, the timer 113 is shut off and a signal is delivered through the controller 116 and the signal conductors 102, 92 and 81 to the controller 78 to provide a visual indication at the lamps **77, 77*a*, 77*b* and 77*c* which is responsive to the number of pilots 28 in operation. If cleaning of the spark plugs 49 is desired this may be effected by pressing the push-button 87*a* (FIG. 2) which provides for energization of the solenoid 55 to supply gas jets directed to the points of the spark plugs 49**.

I claim:

1. In combination, an offshore platform having a supply of combustible waste gas and means for supplying fuel gas, an offshore flare for combustion of waste gas in spaced relation to said platform and having a burner at its free end, said flare having a pilot to which fuel gas is supplied for igniting the waste gas delivered to said burner, means on said platform for activating said pilot, control means on said flare for said pilot, a submerged conduit for delivery of waste gas to said burner for combustion, and submerged connecting means between said platform and said flare comprising means for delivery of fuel gas to said pilot, and connecting means between said activating means on said platform and said control means on said flare.

2. The combination defined in claim 1 in which means is provided on said platform and said flare for initiating ignition, including a fuel gas connection on said flare to an ignitor pipe extending to said pilot, and members are provided for igniting the fuel gas in said ignitor pipe to provide a pilot igniting flame front.

3. The combination defined in claim 1 in which said offshore platform has a supply of fuel gas, and means is provided for reducing the liquid content of the fuel gas.

4. The combination defined in claim 3 in which dew point sensing means is provided on said platform in advance of said submerged connecting means.

5. The combination defined in claim 4 in which an alarm member is provided responsive to said dew point sensing means.

6. The combination defined in claim 1 in which fuel gas drier means is provided in advance of said submerged connecting means.

7. The combination defined in claim 1 in which fuel gas pressure control means is provided at said offshore platform.

8. The combination defined in claim 1 in which pressure responsive means is provided for controlling the delivered pressure of said fuel gas.

9. The combination defined in claim 1 in which said control means on said flare comprises a member responsive to the temperature at said pilot, and members for controlling the delivery of fuel gas to said pilot.

10. The combination defined in claim 1 in which said igniting means includes an ignitor for said pilot, and said control means further comprises members for controlling the delivery of fuel gas to said ignitor.

11. The combination defined in claim 1 in which said igniting means includes a spark member at said flare, and means for supplying fluid for cleaning said spark member, and said control means on said platform includes means for activating said means for supplying cleaning fluid.

12. The combination defined in claim 1 in which control members are provided on the offshore flare connected to the control means on said platform through said submerged connecting means.

13. The combination defined in claim 1 in which said means for delivery of fuel gas to said pilot comprises a plurality of conduits with members for selectively controlling the flow through said conduits.

14. The combination defined in claim 13 in which said conduits are connected respectively to a manifold at said platform and a manifold at said flare.

15. The combination defined in claim 13 in which said conduits are connected to said manifolds through valves.

16. The combination defined in claim 1 in which power supply means is provided on said platform for said control means, and an auxiliary power supply is provided on said flare.

17. The combination defined in claim 1 in which a protective enclosing means is provided for at least a part of said submerged connecting means.

18. The combination defined in claim 17 in which said protective enclosing means comprises a metallic covering.

19. The combination defined in claim 17 in which said protective enclosing means comprises a metallic tubular member at said flare in spaced relation to said submerged connecting means.

20. The combination defined in claim 1 in which a shield is provided on said flare in covering relation to said control means for preventing access of burning liquid droplets.

* * * * *